US006148587A

United States Patent [19]

McDonald et al.

[11] Patent Number: 6,148,587

[45] Date of Patent: *Nov. 21, 2000

[54] BAG WITH AN ACCESS HOLE IN ONE PANEL

[75] Inventors: Gregory E. McDonald; Andrew W. Moehlenbrock, both of Simpsonville; John Carson, Spartanburg, all of S.C.

[73] Assignee: Cryovac, Inc., Duncan, S.C.

[ * ] Notice: This patent issued on a continued prosecution application filed under 37 CFR 1.53(d), and is subject to the twenty year patent term provisions of 35 U.S.C. 154(a)(2).

[21] Appl. No.: 09/116,629

[22] Filed: Jul. 16, 1998

Related U.S. Application Data

[62] Division of application No. 08/522,053, Aug. 31, 1995, Pat. No. 5,810,706.

[51] Int. Cl.[7] ..... B65B 1/04

[52] U.S. Cl. ..... 53/255; 53/384.1; 53/572

[58] Field of Search ..... 53/255, 256, 384.1, 53/572, 573

[56] References Cited

U.S. PATENT DOCUMENTS

| | | | |
|---|---|---|---|
| 584,659 | 6/1897 | Appel . | |
| 3,054,441 | 9/1962 | Gex et al. | 156/515 |
| 3,162,347 | 12/1964 | Hannon | 229/69 |
| 3,308,722 | 3/1967 | Peterson | 93/35 |
| 3,352,411 | 11/1967 | Schwarzkopf | 206/57 |
| 3,372,857 | 3/1968 | Brayla | 229/53 |
| 3,537,225 | 11/1970 | Fields | 53/14 |
| 3,547,340 | 12/1970 | McDonald | 229/161 |
| 3,587,843 | 6/1971 | Wing | 206/57 |
| 3,698,547 | 10/1972 | Roberts et al. | 206/57 |
| 3,707,826 | 1/1973 | Cole | 53/384 |
| 3,748,205 | 7/1973 | Adams | 156/252 |
| 3,763,627 | 10/1973 | Kupcikevicius et al. | 53/89 |
| 3,770,134 | 11/1973 | Kupcikevicius | 53/572 |
| 3,783,580 | 1/1974 | Raudys | 53/29 |
| 3,802,324 | 4/1974 | Izumi et al. | 93/35 |
| 3,804,322 | 4/1974 | Ericson | 229/53 |
| 3,868,891 | 3/1975 | Parish | 93/8 |
| 3,896,981 | 7/1975 | Purple | 224/45 |
| 3,980,225 | 9/1976 | Kan | 229/57 |
| 4,055,109 | 10/1977 | Kan | 93/35 |
| 4,076,122 | 2/1978 | Hall | 206/460 |
| 4,085,822 | 4/1978 | Osborn | 186/1 |
| 4,110,956 | 9/1978 | Weisberg | 53/558 |
| 4,165,832 | 8/1979 | Kuklies et al. | 229/54 |
| 4,387,550 | 6/1983 | Lerner | 53/459 |
| 4,500,307 | 2/1985 | Bridgeman | 493/196 |
| 4,526,565 | 7/1985 | Hummel et al. | 493/196 |
| 4,533,425 | 8/1985 | Wehle | 4156/466 |
| 4,595,389 | 6/1986 | Lehmacher | 493/227 |
| 4,598,529 | 7/1986 | Pongrass et al. | 53/452 |

(List continued on next page.)

FOREIGN PATENT DOCUMENTS

| | | |
|---|---|---|
| 59-208393 | 6/1993 | Japan . |
| 1652-207 | 11/1988 | Russian Federation . |
| 1822842 A1 | 2/1991 | Russian Federation . |
| 1652207 A1 | 5/1991 | U.S.S.R. . |
| 1822842 A1 | 6/1993 | U.S.S.R. . |
| 1 481 439 | 10/1974 | United Kingdom . |
| 2 176 165 | 6/1985 | United Kingdom . |
| WO93/11050 | 6/1993 | WIPO . |
| WO 93/15959 | 8/1993 | WIPO . |

OTHER PUBLICATIONS

Cutting Modules, Best Cutting Die Company, pp. 1–5.

*Primary Examiner*—Eugene Kim

[57] ABSTRACT

A bag includes a first panel with at least one access hole in it, and a second panel without a hole corresponding to the at least one hole of the first panel. Preferably, two holes are present, preferably near the bag mouth. The panels are substantially equal in length. The bag can be easily opened by described bag opening means, without the need for vacuum or air to open the bag. The bag can be used in conjuction with otherwise conventional taped bag systems. A metod of making the bag, a bag opening system, a method of opening the bag, and a packaging system are also disclosed.

7 Claims, 6 Drawing Sheets

U.S. PATENT DOCUMENTS

| | | | |
|---|---|---|---|
| 4,644,735 | 2/1987 | Savigny | 53/384.1 |
| 4,653,295 | 3/1987 | Odabashian et al. | 383/127 |
| 4,760,684 | 8/1988 | Crosby | 53/384.1 |
| 4,762,514 | 8/1988 | Yoshida | 493/227 |
| 4,798,042 | 1/1989 | Davis | 53/573 |
| 4,931,033 | 6/1990 | Leeds | 493/195 |
| 5,080,643 | 1/1992 | Mitchell et al. | 493/195 |
| 5,080,747 | 1/1992 | Veix | 156/352 |
| 5,094,061 | 3/1992 | Evers | 83/861 |
| 5,115,626 | 5/1992 | Rutter et al. | 53/468 |
| 5,147,272 | 9/1992 | Richison et al. | 493/195 |
| 5,254,073 | 10/1993 | Richison et al. | 493/195 |
| 5,467,572 | 11/1995 | Wile et al. | 53/384.1 |
| 5,514,067 | 5/1996 | Schmidt et al. | 493/196 |
| 5,542,902 | 8/1996 | Richison et al. | 493/195 |

BAG WITH AN ACCESS HOLE IN ONE PANEL

This is a divisional of application Ser. No. 08/522,053, filed on Aug. 31, 1995, now U.S. Pat. No. 5,810,706.

FIELD OF THE INVENTION

The present invention relates to a bag with at least one access hole in one panel of the bag; a method of making the bag; a bag opening system; a method of opening the bag; and a packaging system.

BACKGROUND OF THE INVENTION

Many packaging applications, especially food packaging, require or benefit from the use of bags made from various thermoplastic materials and structures. Examples of commercial bags include heat shrinkable bags supplied by the Cryovac Division of W. R. Grace & Co.-Conn., including the L 340, B620, and B2550 bags.

These bags are commonly used in large scale meat processing and/or packaging systems where production speed and efficiency are important. Bags to be used in these systems are often themselves packed in boxes, the individual bags taped together so that they will feed in a predictable and efficient manner to an article loading station. Typical of such technology is U.S. Pat. No. 3,161,347 (Hannon), disclosing a tape to which bags are attached, and U.S. Pat. No. 3,587,843 (Wing), incorporated herein by reference in its entirety, disclosing two tapes to which are attached imbricated (i.e. shingled) bags.

At the loading station of a conventional system, each bag is opened and then loaded with an article such as a fresh red meat subprimal or smoked and processed meat, poultry, cheese, or other perishable food product, or other product.

One problem sometimes encountered is that of bag lips (the edges of the bag panels which form the bag opening) which can be undesirably stuck together, or stuck to the adhesive bag tapes. This can mean a significant slow-down in a packaging line, and down-time for the food processor or other user of bags. The bags can of course be opened manually, but this is very slow and labor intensive. It also risks unnecessary handling of the bag.

Some solutions have been offered to deal with the problem of opening a bag prior to the insertion of an article into the bag. The use of air pressure or vacuum is common, but of course requires a source of vacuum or air pressure. Sometimes the use of air pressure is unpredictable in providing consistent bag opening performance. Even in the case of air pressure, the worker sometimes needs to manually start the opening process so that the air can be effective in further opening the bag sufficiently to allow an article to be loaded therein.

It is desirable to provide a method and bag which lessen or eliminate the requirement of opening the bag manually, or of using vacuum or air pressure. It is also desirable to provide a method of opening the bag in a reliable and consistent manner, which allows for increased automation, and potentially reduces operating costs.

Another problem inherent in conventional bag loading systems is the requirement to match center to center tape spacing to the bag size and article cross section. "Tape spacing" here refers to the pair of adhesive carrier tapes, e.g. as described in the '843 Wing patent, which in many commercial bag loading systems hold bags together before loading with an article. Currently, the nature of the tape spacing will generally define the shape of the bag when it is opened. Since the bag dimensions are ideally matched to the dimensions of the article to be packaged, tape spacing is an important parameter in loading a bag with an article. It is desirable to provide a method and bag which lessen or eliminate the requirement of matching tape spacing to article size, i.e. of optimizing tape spacing for feeding or indexing the bags.

Still another problem often encountered in the packaging of food products is that the corners of each bag tend to curl over during bag advance and loading. This can sometimes complicate or slow the bag loading process. By finding a way to widen the tape spacing, that is, by placing the tapes closer to the bag's respective lateral edges, without being unduly limited in the need to match tape spacing to bag and article size, this problem is lessened or eliminated.

An additional problem is the variation in tape alignment and in spacing between successive bags in a stacked array of imbricated bags.

It is desirable to provide a method and system for accurately locating and positioning bags in an imbricated bag system.

SUMMARY OF THE INVENTION

In one aspect, the invention is a bag comprising a first panel; a second panel; the first and second panels having substantially the same length and width; a first bag edge; a second bag edge; a bag bottom; a bag mouth; and a hole disposed in the first panel, but without a corresponding hole in the second panel.

In a second aspect, the invention is a method of making a bag, the method comprising providing lay-flat tubing comprising a first tubing panel and a second tubing panel; making a hole in the first tubing panel; and sealing and cutting the tubing to make a bag having a hole in a panel of the bag.

In a third aspect, the invention is a method of making a bag, the method comprising providing lay-flat tubing in a first lay-flat orientation; advancing the lay-flat tubing such that at least a portion of the lay-flat tubing is reoriented to a position at a right angle to its first lay-flat orientation; making a hole in the tubing; further advancing the tubing while reorienting the tubing back to its first lay-flat orientation; and sealing and cutting the reoriented tubing to make a bag having a hole in a panel of the bag.

In a fourth aspect, the invention is a bag opening system comprising a bag comprising a first panel with a hole therein, a second panel without a hole corresponding to the hole of the first panel, the first and second panels having substantially the same length, the first and second panels having substantially the same width, a bag mouth, and a bag bottom; and means for opening the bag comprising means for contacting the second panel by access through the hole of the first panel.

In a fifth aspect, the invention is a method of opening a bag comprising providing a bag comprising a first panel with a hole therein, a second panel without a hole corresponding to the hole of the first panel, the first and second panels having substantially the same length, the first and second panels having substantially the same width, a bag mouth and a bag bottom; advancing said bag toward a means for opening the bag, the means having a protrusion mounted thereon; and activating said bag opening means so that the protrusion passes through the hole of the first panel, and into contact with the second panel of the bag so as to push the second panel.

In a sixth aspect, the invention is a packaging system comprising a plurality of bags, each bag comprising a first panel with a hole, a second panel without a hole corresponding to the hole of the first panel, the first and second panels having substantially the same length, the first and second panels having substantially the same width, a bag mouth, and a bag bottom; and an adhesive tape to which the plurality of bags are attached in a shingled arrangement.

In a seventh aspect, a method of opening a bag comprises providing a bag comprising a first panel, a second panel, the first and second panels having substantially the same length, the first and second panels having substantially the same width, a bag mouth, and a bag bottom; advancing said bag toward a means for opening the bag, the means having a sharp protrusion mounted therein; and activating the means for opening the bag so that the sharp protrusion makes a hole in the first panel, and comes into contact with the second panel of the bag so as to push the second panel.

DESCRIPTION OF THE PREFERRED EMBODIMENTS

Figure 1:
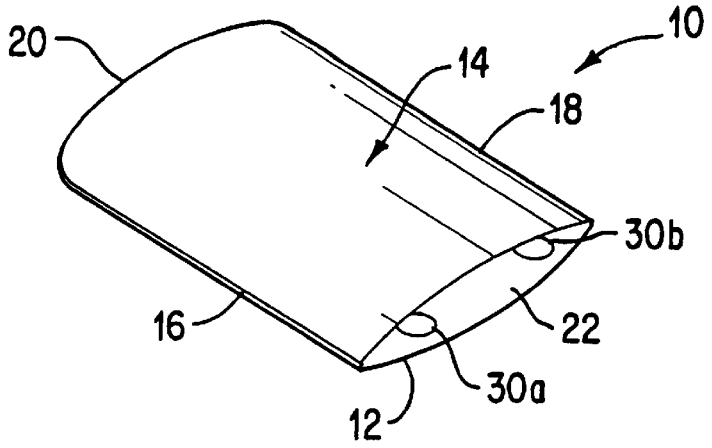
FIG. 1 is a perspective view of a bag according to the invention.

In FIG. 1, a bag 10 according to the invention is shown. It includes a first panel 12, and a second panel 14. Each panel can be regarded as having a first end, first and second sides, and a second end. As viewed in a substantially lay-flat condition, panels 12 and 14 each have substantially the same length, and each have substantially the same width. A first bag edge 16 is formed by respective communicating first sides of the first and second panel; a second bag edge 18 is formed by respective communicating second sides of the first and second panel; a bag bottom 20 is formed by respective communicating first ends of the first and second panel; and a bag mouth 22 is formed by respective second ends of the first and second panel.

Bags currently are typically made as side seal bags or end seal bags.

The side seal bag will have a heat seal at opposite bag edges. The bag bottom will be formed by the fold of film created during the extrusion of bag tubing during manufacture. The opposite fold of film is slit to form a bag mouth.

An end seal bag will have opposite bag edges formed by the fold of film created during the extrusion of bag tubing during manufacture. The bag bottom will be a curved or straight heat seal. The bag mouth is curved or straight, and formed by a transverse cut in the extruded tubing.

In both of these cases, the bag is made from a long length of bag tubing.

Bags of the present invention are preferably made from tubing. It is of course possible to use this invention with other embodiments, such as two discrete film panels which are of substantially the same size, and brought together and sealed along two edges and the bottom to form a bag. Thus, although each panel (i.e. major wall) of the bag can be regarded as having a first end, first and second sides, and a second end, and although the bag edges are described as being joined portions of respective sides of the first and second panels of the bag, it will be understood that in fact a particular bag edge, or bag bottom, can be formed either from a true seal between two webs or panels of film, or from a fold of an originally single web of film, such as the tubular extruded "tape" typical of many film and bag making operations. Alternatively, a large sheet can be folded and sealed to form a folded bottom configuration typical of side or transverse seal bags.

At least one hole is disposed in the first panel but without a corresponding hole in the second panel. If the second panel contained a hole lined up with the hole of the first panel, then the invention would not operate as described herein because the means for opening, when activated, would not push up against the inside surface of the second panel and open the bag. Of course, it is possible to have non-corresponding holes in the second panel, which could function for other reasons than for opening the bag as described herein.

The hole is preferably disposed closer to the bag mouth than to the bag bottom. The hole is more preferably placed close enough to the bag mouth 22 (i.e. the second ends of the respective bag panels which form the opening through which the article to be packaged will enter the bag) so that the present method and system can be used with the appropriate distance between successive imbricated bags. This distance between successive imbricated bags is conventionally typically about one inch. In connection with the present invention, this distance is preferably between two and three inches. Most preferably, therefore, the center of the hole or holes is three inches or less from the bag mouth. The placement of the hole should not, at least for most food packaging applications, be so far from the bag mouth that upon subsequent loading of an article into the bag, and closure of the bag, the hole is part of the package proper, i.e. the hole preferably does not expose the packaged article to the environment. It is more preferable to use two holes 30*a* and 30*b* to ensure a more stable and controlled operation. More than two holes can be used. If two holes are used, they are preferably placed an equal distance from respective bag edges 16 and 18, and preferably the same distance from the bag mouth. Each hole is preferably less than two inches in diameter, more preferably less than one inch in diameter, most preferably about ¾ inches in diameter.

The bag mouth 22 is formed by respective second edges of first panel 12 and second panel 14. For the sake of clarity, it is shown in FIG. 1 as slightly opened.

Other components typical of a bag loading system can be used with benefit in connection with the present invention. These are well known and conventional and need no further description for those skilled in the art.

Figure 2:
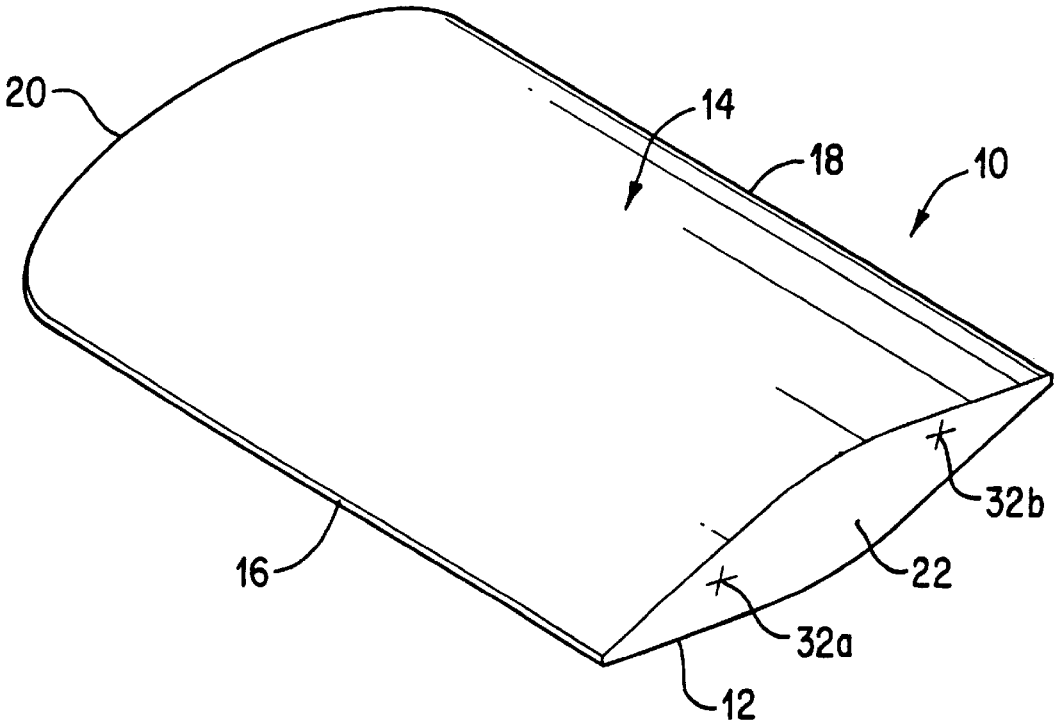
FIG. 2 is a perspective view of an alternative embodiment of a bag according to the invention.

FIG. 2 shows an alternative embodiment, in which cross-slits 32*a* and 32*b* are used instead of an actual hole 30*a* and 30*b*. As used herein, "hole" refers both to a true hole of any suitable shape and size, as well as cross-slits, perforations, partially cut-out flaps, or the like, as disclosed and claimed further herein.

Figure 3:
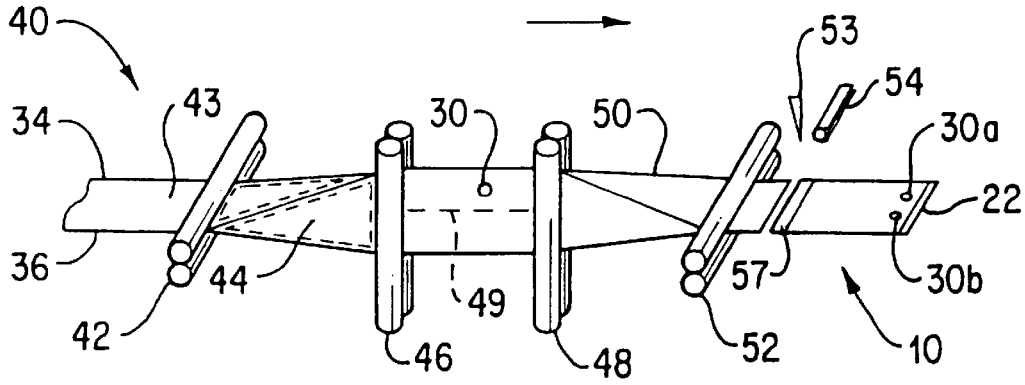
FIG. 3 is a schematic perspective view of a method of making the bag of FIGS. 1 and 2.
Figure 6:
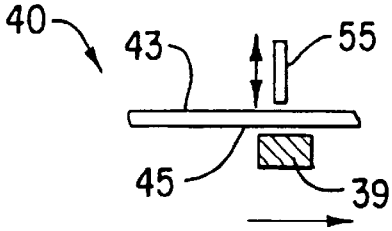

FIG. 3 shows a schematic view of a method of making the bag of FIGS. 1 and 2. A lay-flat tubing 40 has two major surfaces: a first tubing panel 43, and a second tubing panel 45 (best seen in FIG. 6). "Lay-flat tubing" refers herein to a tubular film which has been extruded or made by any suitable process, and is in a flattened or "lay-flat" condition. When individual bags are made from this tubing as described in detail herein, each first panel 12 will preferably correspond to or derive from a section of first bag tubing panel 43, and each second panel 14 will preferably correspond to or derive from a section of second tubing panel 45. Typically, the lay flat tubing will have a first tubing edge 34 and second tubing edge 36, i.e. a pronounced crease created on each lateral edge of the lay flat tubing by prior extrusion and processing. Each first bag edge 16 and second bag edge 18 will preferably corrrespond to or derive from a section of tubing edges 34 and 36 respectively, after processing as described below.

The lay-flat tubing 40 is advanced through a first pair of nip rolls 42 to a second pair of nip rolls 46 disposed at a right angle to the first set 42, such that the lay-flat orientation of the tubing 40 is changed to a position at a right angle to its original lay-flat orientation. An arrow in the drawings shows the direction of movement of the tubing. A means for reorienting 44 can be simply a bubble of air trapped between nip rolls 42 and 46, or can be e.g. an internal mandrel, e.g. a tetrahedral mandrel which guides the tubing into the new orientation. If a bubble of air is used, it is preferably pressurized to aid in reorientation of the tubing. It should be noted here that "orientation" is used here not in the sense often associated with describing heating and stretching processes for rendering films heat shrinkable, but rather to mean a change in the relative disposition of the tubing. An analogy would be to take a hot water bottle, and press it in at its lateral edges until the bottle is repositioned with its new wide dimension at 90 degrees to its original dimension.

In some cases, the lay-flat tubing 40 can be reoriented by simply drawing it through the second pair of nip rolls 46, without the aid of the means 44 discussed above. This can be done directly from a roll holding lay-flat tubing, or via the first pair of nip rolls 42.

The tubing is advanced through a third set of nip rolls 48 disposed like nip rolls 46. A hole is made in the tube, by any suitable means such as a die punch 55, at some point between nip rolls 46 and 48. FIG. 3 shows a possible location for the hole 30. It will be evident that the closer the hole is to an edge of the tubing, the closer the holes 30*a* and 30*b* will be to each other in the final bag. The closer the hole is to the centerline 49 of the tubing, shown as a dashed line in FIG. 3, the farther the holes 30*a* and 30*b* will be from each other in the final bag. Centerline 49 will typically represent the location of tubing edges 34 and 36.

More than one hole can be made in the tubing.

Making a hole in the tubing, and thus in the bag derived therefrom, has the disadvantage of leaving a piece of thermoplastic material which must be disposed of, and which can potentially fall into a bag during processing. Instead of a complete hole, with material removed, the tubing can be lanced by any suitable means such as a knife. Possible configurations include cross-slits (as shown in FIG. 2), perforations, partially cut-out circles which leave a flap of material, or the like. Partially cut holes with flaps can reduce tearing due to rigid hole cuts if in use only the folded flap edge is stressed. The only necessary criterion for the configuration of hole or holes 30 or 30*a* and 30*b* is that the means for opening will function adequately to open the bag 12 as described herein.

The tubing 40 is then advanced to a fourth pair of nip rolls 52, which are disposed at a right angle to nip rolls 48 and coincide in orientation with nip rolls 42. The tubing is thus returned to its original orientation. An internal mandrel, or other suitable means for reorienting 50 can again be applied to facilitate the process. Alternatively, the tubing can be returned to its original orientation without the use of reorienting means, or can be reoriented by simply drawing it through the fourth pair of nip rolls 52, without the aid of the means 50 discussed above.

A means for cutting 53, e.g. a knife, separates the tubing 40 to define a tube section with two holes 30*a* and 30*b* in one panel of the tube section. A means for sealing 54, e.g. a conventional heat sealer, applies an end seal 57 to one end of the tube section to form a bag bottom 20 of a bag 10. The sealing and cutting function can be optionally performed by a single sealing/cutting device.

Figure 19:
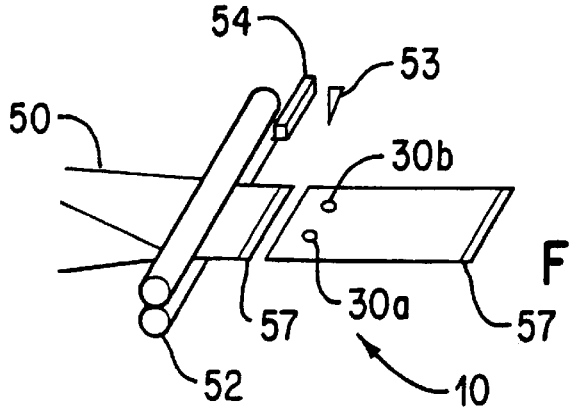
FIG. 19 is a schematic perspective view of an alternative method of making the bag of FIGS. 1 and 2.

Alternatively, the tubing 40 can be reoriented to its original orientation, as described above, and then sealed, advanced, and then cut as shown in FIG. 19.

Figure 20:
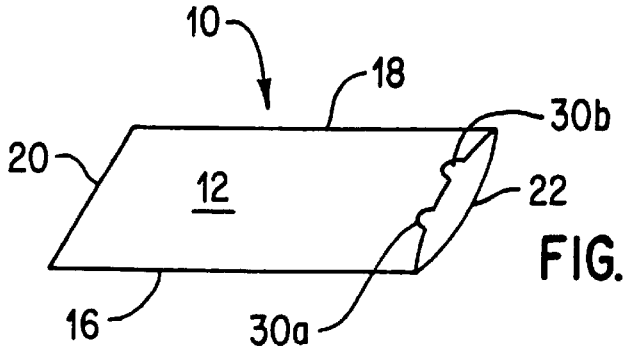
FIG. 20 is a schematic perspective view of a bag with indents made in accordance with the invention.

For end uses where a partial hole or holes is desired, the film, after being reoriented to its first orientation, can be processed as described above, except that the cutting occurs, not on one side or the other of the holes, but directly through the holes. With an appropriate sealing step to create the bag bottom, the result is a bag with hemispheric indents in one panel of the bag (see FIG. 20).

Figure 17:
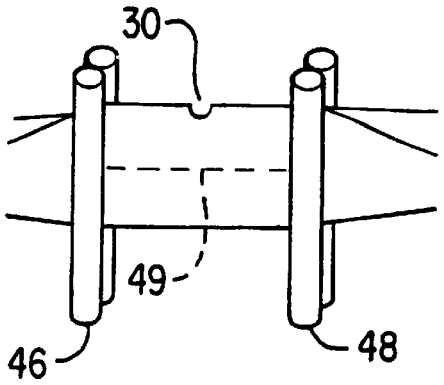
FIGS. 17 and 18 are schematic perspective views of an alternative method of making a bag, and the resulting bag respectively, according to the invention.
Figure 18:
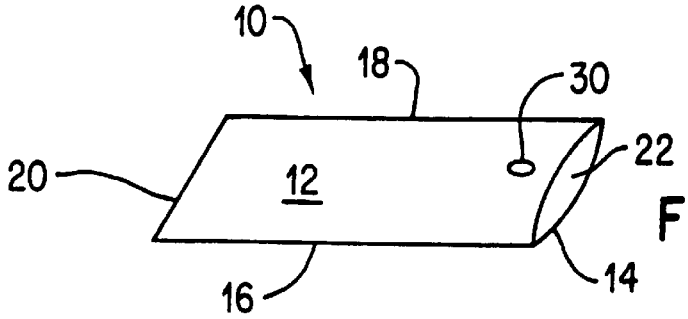
Figure 22:
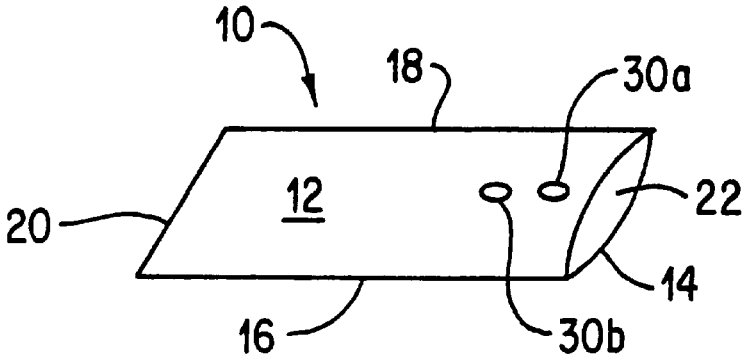
FIG. 22 is a perspective view of an alternative embodiment of a bag according to the invention.

It is clear that a minimum of two holes, or multiples thereof, are made in a bag panel by the specific embodiment shown here. A single hole can also be made in one bag panel, by making a hemispheric hole at one edge of the reoriented tubing. This is shown in FIG. 17. When the tubing is brought back to its original orientation, the tubing will have a single hole located in the lateral center of the tubing, equidistant from the lateral edges 34 and 36 of the tubing. The resulting bag is shown in FIG. 18. If a second hemispheric hole is made in an edge of the reoriented tube, a bag with two holes 30*a* and 30*b* is made, the two holes at differing distances from the bag mouth, but the same distance from each of the bag edges 16 and 18. This is shown in FIG. 22.

Although the lay-flat tubing is shown in FIG. 3 as taking a linear path, alternatively the tubing can be turned during its advance in any suitable way. For example, after the tubing passes through roller 48, it can be turned at some angle, such as 180 degrees, and advanced in the opposite direction to complete the process. This would result in a U-shaped configuration for the process.

Also, although the lay-flat tubing is shown in FIG. 3 as being processed in a horizontal line, the process can be performed at any angle, or in the vertical direction.

Figure 4:
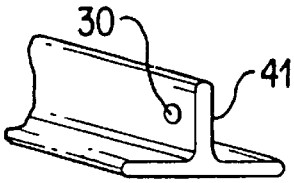
FIG. 4 is a schematic perspective view of an alternative method of making the bag of FIGS. 1 and 2.

Alternative methods for making the bag are possible. For example, in FIG. 4 a lay-flat tubing has been only partially reoriented to provide a portion of the tubing 41 through which a hole 30 can be punched. Thus, only a portion 41 of the lay-flat tubing 40 is reoriented relative to the original orientation of the tubing. This can be done by advancing the tubing through a first set of crimping rolls to "bunch up" a portion of the tubing 40, and a first and second set of short nip rolls to advance the tubing 40 such that a hole 30 is punched through both plies of the portion 41 of the tubing that has been reoriented. After the hole 30 has been made, the tubing is released to its original orientation. Since lay-flat tubing typically has tubing edges as described above, formed during the extrusion and stretching process, the tubing if partially oriented will often have a tendency to return to its original orientation.

It will be evident that any of the nip rolls herein can be of any suitable length and diameter, depending on the specific process used. The nip rolls can be driven, or simply idler rollers.

Figure 23:
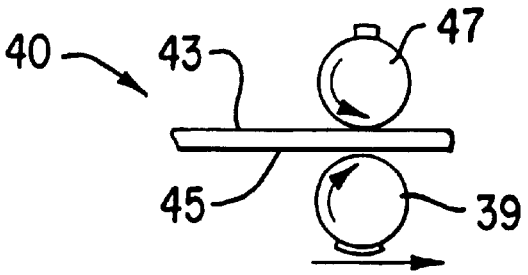
FIG. 23 is a schematic, elevational view of another alternative method of making the bag of FIGS. 1 and 2.

A rotary die can be used to run across lay flat tubing at periodic intervals to cut through one panel, but not the other panel of the tubing (FIG. 23). Some scoring of the inside of the second panel can occur, but this is not critical as long as an actual hole or slit is not created in the second panel. With this alternative, a single hole can be made in the bag panel.

Of course, one or more holes could be manually made in individual bags, but this is not commercially feasible.

Figure 5:
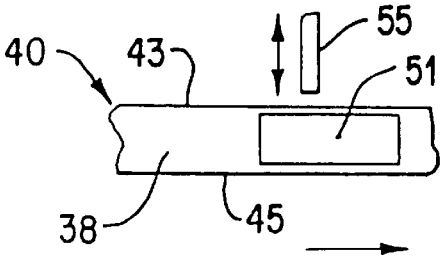
FIGS. 5 and 6 are schematic, elevational views of alternative methods of making the bag of FIGS. 1 and 2.

In FIG. 5, a die punch 55 creates a hole in a first panel 43 of the lay-flat tubing 40. This can be done using an internal backing mandrel 51 as a backing plate, to prevent the hole from extending to the second panel 45 of the tubing. Alternatively, the punch can be used on the lay-flat tubing as is, without the use of an internal backing mandrel 51. In this case (see FIG. 6), the operation of the punch 55 must be accurate enough to create a hole 30 in the first panel 43, but not extend through the second panel 45 of tubing 40. A backing plate 39 can be used on the opposite side of the tubing from the punch 55.

Although the above discussion is primarily directed to a method of making an end-seal bag, FIG. 5 can also be viewed as a method of making a hole in a panel of a side seal bag. In this embodiment, the space 38 between panels 43 and 45 can be regarded as a space created by slitting the first tubing edge 36 by any appropriate slitting means. After one or more holes are punched into tubing panel 43, the tubing can be further processed by cutting and sealing, as described herein, with a transverse seal made at each edge of a tube section, to create a side seal bag whose mouth is represented by a portion of the spacing between panels 43 and 45, and whose bag bottom is represented by a portion of first tubing edge 34.

Figure 7:
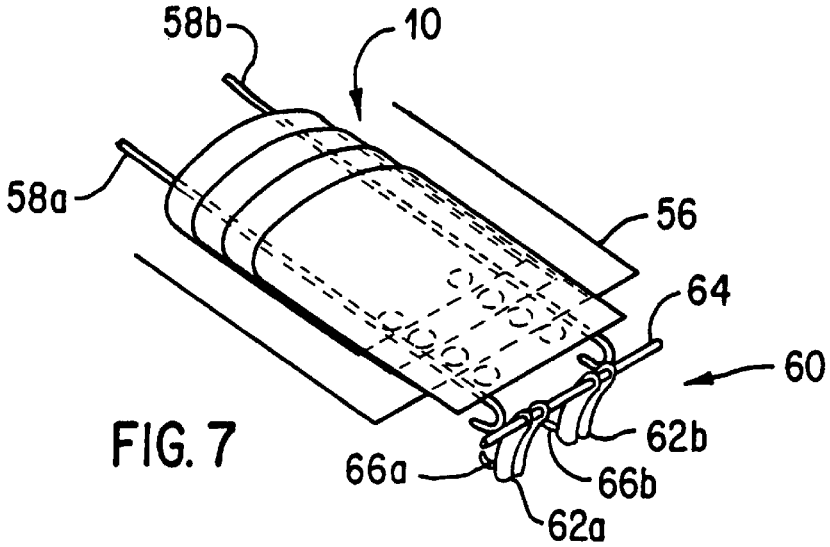
FIG. 7 is a perspective view of a bag opening system in its start-up position.

FIG. 7 shows a bag opening system in its start-up position. Imbricated (shingled) bags are supported by support platform 56. The bags are positioned on the platform 56 by a conventional bag indexer (not shown) or any suitable device or process. The bags are attached in conventional fashion to first bag tape 58*a* and second bag tape 58*b*. The tape typically underlies the plurality of imbricated bags. The bags are shingled "forward", i.e. the topmost bag in the stack of bags is furthest advanced or forward, and closest to the means for opening 60 to be described below.

The means for opening 60 is illustrated as a device having a first cam plate 62*a* having a projecting first finger 66*a* mounted thereon, and a second cam plate 62*b* having a projecting second finger 66*b* mounted thereon. The cam plates are rigidly attached to shaft 64.

Figure 8:
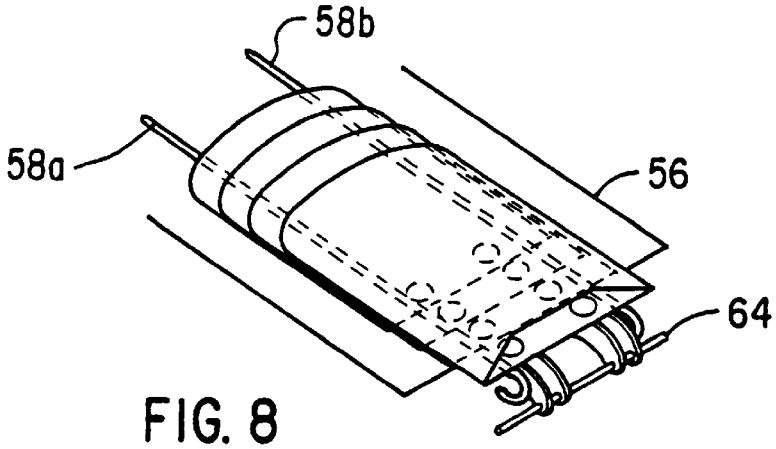
FIG. 8 is a perspective view of a bag opening system as the bag is opened.

FIG. 8 shows the bag opening system after it has been activated. The second (top) panel of the topmost bag in the plurality of bags is shown as being lifted up by the action of fingers 66*a* and 66*b* coming up through the holes 30*a* and 30*b* of the bag. The finger action is initiated by rotating the shaft 64 to rotate cam plates 62*a* and 62*b* upward. The mounted fingers thus pass through holes 30*a* and 30*b* of the bag.

Figure 9:
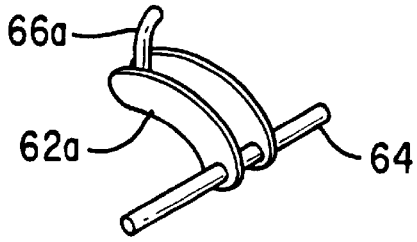
FIG. 9 is a enlarged perspective view of an opening device in accordance with the invention.

FIG. 9 shows in enlarged view a portion of the means for opening 60.

FIGS. 10 through 14 schematically show a sequence for opening a bag. Although described with respect to a single cam plate and finger, it will be understood that where more than one bag hole is present, and more than one cam plate and finger form part of the means for opening, these will also operate in similar and simultaneous fashion. Thus, the means for opening can comprise a single cam plate and finger, or multiple cam plates and fingers, affixed to a rotating shaft.

Figure 10:
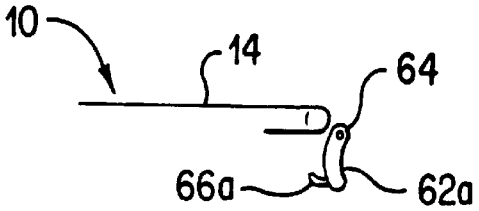
FIGS. 10–14 are side elevation views of the sequence of bag opening and advancement in accordance with the invention.
Figure 11:
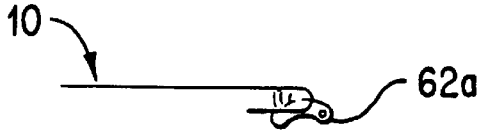
Figure 12:
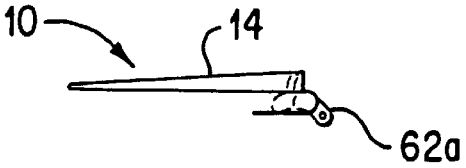
Figure 13:
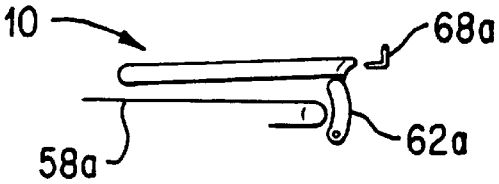
Figure 14:
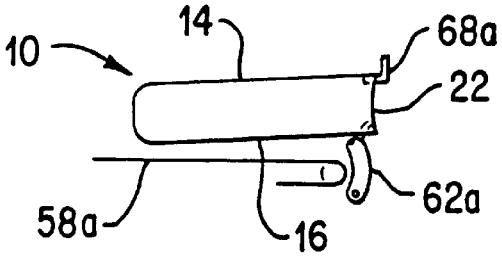
Figure 15:
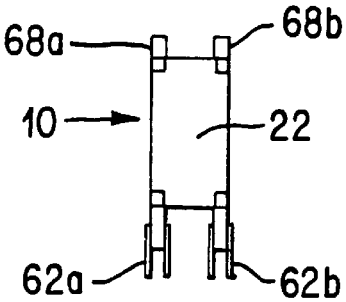
FIGS. 15 and 16 are end elevations of opening geometries obtainable by the practice of the invention.
Figure 16:
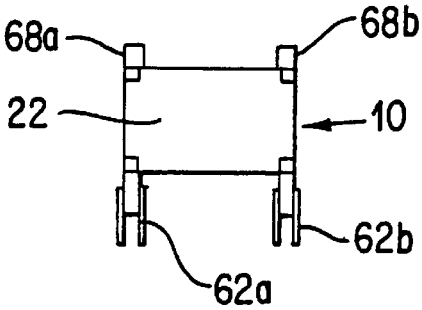

In FIG. 10, shaft 64 begins to rotate, causing first cam plate 62*a* to also rotate, thus causing first finger 66*a* to rise and protrude through hole 30*a*. In FIG. 11, the finger contacts the bottom side (inside) of the second panel 14 of bag 10. In FIG. 12, further rotation of shaft 64 and cam plate 62*a* causes further upward movement of finger 66*a*, in turn forcing the second panel 14 upward and away from the first panel 12 in the vicinity of the bag mouth 22. In FIG. 13, upon still further rotation of shaft 64, the finger 66*a* can protrude through the bag mouth 22. The cam plate 62*a*, if suitably shaped, will preferably contact the exterior (here, bottom) side of first panel 12. If a bag tape or tapes are present, it can peel the bag away from the tape or tapes. Peeling force transmitted to the tape is resisted by the tape indexer (not shown) thus maintaining tension and preventing buckling of the tape. In some cases, it may be necessary to open the bag mouth 22 still further to allow for insertion of an article directly, or the insertion of loading horns (present in some bag loading operations) which in turn facilitate insertion of the article to be packaged, such as poultry or other food or non-food products. FIGS. 13, 14, 15, and 16 show the insertion of supplemental fingers 68*a* and 68*b* horizontally (in this case) into the opening in the bag mouth created by the above described steps and system. FIGS. 15 and 16 show two of many bag geometries which can be achieved by the present invention. In FIG. 15, the holes 30*a* and 30*b*, and the fingers of the means for opening 60, are relatively close together. Supplemental fingers 68*a* and 68*b* are positioned to correlate with the positioning of the holes and means for opening. In FIG. 16, the holes 30*a* and 30*b*, and the means for opening 60, are relatively far apart. Supplemental fingers 68*a* and 68*b* are positioned to correlate with the positioning of the holes and means for opening.

An article such as a food article can thereafter be manually or mechanically loaded into the bag, and any subsequent packaging steps, such as vacuumizing, heat sealing, shrinking, etc. can be performed as desired.

Figure 21:
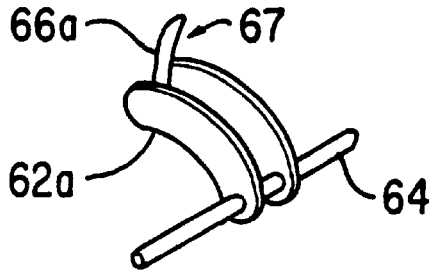
FIG. 21 is an enlarged perspective view of an alternative embodiment of an opening device in accordance with the invention.

An alternative embodiment of a means for opening 60 is shown in FIG. 21. This is like the means shown in FIG. 9, but includes a pointed tip 67. By the use of this device, a hole can be made in a bag, and then the bag can be opened, in a single operation. The protrusion 66*a* and pointed tip 67 can be of any suitable material and shape to accomplish the creation of the hole, and opening of the bag. This alternative device can function, as a method of bag opening, as described for the embodiments disclosed and described herein with reference to FIGS. 7 through 14. Thus, a means for making a bag with a hole, and a bag opening means, are combined in a single device and step. In such a system, a plurality of bags would typically be taped in an imbricated fashion. This arrangement can provide the force which will resist the piercing force of protrusion 66*a* with pointed tip 67, and thereby allow a hole to be punched through the first panel. The second panel would be typically unconstrained (no adhesive tape) and has trivial weight, so that the pointed tip 67 will lift, not puncture, second panel 14.

It is to be understood that variations of the present invention can be made without departing from the scope of the invention, which is not limited to the specific embodiments and examples disclosed herein, but extends to the claims presented below.

For example, any number of holes, cross-slits, perforations, or the like, of any suitable shape, size, and location can be used, as long as the result is a bag that can be opened by the action of means for opening acting through a hole in a first panel, to push against a second panel. Although the invention as described herein is preferably used in connection with taped bags (a very common commercial bag system), it can be beneficially used even without the use of adhesive tapes.

The methods and systems described and claimed herein can be used to advantage to make bags with panels of uneven length.

Holes can be made by any suitable process, including flame and laser.

Any films, especially thermoplastic films such as olefinic films with or without oxygen barrier functionality, can be used with benefit in this invention. These films are made by extrusion coating, coextrusion, lamination, or other suitable processes. Especially preferred for many applications are films comprising an outer layer, an intermediate layer, and an inner layer. The materials of the outer layer are often chosen for abuse resistance and/or sealability, and can be chosen from any suitable polymeric materials such as polyolefins, especially ethylenic polymers and copolymers, polypropylene, polyesters, polyamides, and the like. The inner layer materials, often chosen for sealability, can be any of the materials described for the outer layer. The intermediate layer materials are often chosen for their barrier qualities (i.e. barriers to oxygen, moisture, carbon dioxide, etc.). Preferred materials include polyvinylidene chloride polymers and copolymers, ethylene vinyl alcohol copolymer, polyvinyl alcohol, polyamide, polyester, acrylonitrile, and the like. Bags are preferably heat shrinkable, but can be non-shrinkable, and preferably at least partially crosslinked. Preferred films are multilayer in construction, such as four, five, six, and seven or more layers. This invention can also be used with benefit for paper products.

What is claimed is:

1. A method of opening a bag comprising:

a) providing a bag comprising:
- i) a first panel with a hole therein,
- ii) a second panel without a hole corresponding to the hole of the first panel,
- iii) the first and second panels having substantially the same length,
- iv) the first and second panels having substantially the same width,
- v) a bag mouth, and
- vi) a bag bottom;

b) advancing said bag toward a means for opening the bag, the means having a protrusion mounted thereon; and c) activating said bag opening means so that the protrusion passes through the hole of the first panel, and into contact with the second panel of the bag so as to push the second panel.

2. The method of claim 1 wherein the first panel has two holes.

3. The method of claim 1 wherein step b) is performed by positioning said bag, along with a plurality of bags of the type defined in step a), in imbricated arrangement on an adhesive strip, and advancing said bags along a path by adhering said first panel of each bag to said adhesive strip so that said bag mouth of each bag is positioned transverse to said path and at a leading edge of said bag with respect to a direction of advance of said bag along said path.

4. The method of claim 1 wherein the plurality of bags is sequentially advanced to the means for opening the bag.

5. A method of opening a bag comprising:

a) providing a bag comprising:
- i) a first panel,
- ii) a second panel,
- iii) the first and second panels having substantially the same length,
- iv) the first and second panels having substantially the same width,
- v) a bag mouth, and
- vi) a bag bottom;

b) advancing said bag toward a means for opening the bag, the means having a sharp protrusion mounted thereon; and c) activating said means for opening the bag so that the sharp protrusion makes a hole in the first panel, and comes into contact with the second panel of the bag so as to push the second panel.

6. A bag opening system comprising:

a) a bag comprising:
- i) a first panel with a hole therein,
- ii) a second panel without a hole corresponding to the hole of the first panel,
- iii) the first and second panels having substantially the same length,
- iv) the first and second panels having substantially the same width,
- v) a bag mouth, and
- vi) a bag bottom; and b) a means for opening the bag comprising means for contacting the second panel, by access through the hole of the first panel;

wherein the means for contacting the second panel comprises a cam plate, and a finger mounted on the cam plate, the finger adapted to protrude through the hole and contact the second panel.

7. A bag opening system comprising:

a) a bag comprising:
- i) a first panel with a hole therein,
- ii) a second panel without a hole corresponding to the hole of the first panel,
- iii) the first and second panels having substantially the same length,
- iv) the first and second panels having substantially the same width,
- v) a bag mouth, and
- vi) a bag bottom;

b) a means for opening the bag comprising means for contacting the second panel, by access through the hole of the first panel; and c) an adhesive tape to which the bag is attached with other bags in a shingled arrangement.

* * * * *